United States Patent [19]

Smith et al.

[11] 4,071,725

[45] Jan. 31, 1978

[54] PROXIMITY SWITCH FOR FLUID CYLINDERS

[75] Inventors: John L. Smith, Cuyahoga Falls; Clair B. Alexander, Akron, both of Ohio

[73] Assignee: Ibec Industries, Inc., New York, N.Y.

[21] Appl. No.: 661,951

[22] Filed: Feb. 27, 1976

[51] Int. Cl.[2] ..... H01H 35/38

[52] U.S. Cl. ..... 200/82 E; 335/205; 200/81.9 M

[58] Field of Search ..... 200/82 E, 84 C, 81 R, 200/83 L, 81.9 M; 338/12; 340/240, 282; 335/151, 205, 207

[56] References Cited

U.S. PATENT DOCUMENTS

| | | | |
|---|---|---|---|
| 2,310,504 | 2/1943 | Aubert | 200/81.9 M |
| 3,323,087 | 5/1967 | Reed | 335/205 |
| 3,364,361 | 1/1968 | Burger | 290/1 |
| 3,639,868 | 2/1972 | Gasper | 200/81.9 M |

FOREIGN PATENT DOCUMENTS

| | | | |
|---|---|---|---|
| 1,126,632 | 11/1956 | France | 200/84 C |
| 1,394,991 | 5/1975 | United Kingdom | 338/12 |

*Primary Examiner*—Gerald P. Tolin

*Attorney, Agent, or Firm*—Price, Heneveld, Huizenga & Cooper

[57] ABSTRACT

The specification discloses a magnetic proximity sensing apparatus especially adapted for use with fluid cylinders having pistons formed from magnetically attractable material. The apparatus includes clamping means for securing it to a tie rod of a fluid cylinder or directly to the cylinder body in juxtaposition to a side of the cylinder without disassembly of the cylinder. Also included are magnetic actuator means responsive to the proximity of the fluid cylinder piston which close a switch and enable electrical circuitry for controlling fluid valves or other apparatus.

24 Claims, 8 Drawing Figures

PROXIMITY SWITCH FOR FLUID CYLINDERS

BACKGROUND OF THE INVENTION

This invention relates to proximity sensing apparatus and, more particularly, to a magnetic proximity sensing device especially adapted for use with fluid motive power cylinders.

It is well known to control various apparatus by sensing the operation of fluid motive power cylinders of either the pneumatic or hydraulic type. By sensing the presence or position of the movable piston within the cylinder, one can control the operation apparatus in response to movement of that piston or, alternately, control the length of the stroke of the fluid cylinder piston itself.

Although many type of proximity sensors have been previously devised, many require the presence of magnetic bodies within the part whose movement or proximity is being sensed in order to properly operate the proximity sensor. This is a particular problem with fluid motive power cylinders, the majority of which are manufactured without magnets in their piston bodies.

Another problem typically encountered in the use of proximity sensors with fluid cylinder is the attachment of the sensor to the body of the cylinder. For proper operation, it is necessary that the sensing apparatus be secured as close as possible to the cylinder itself. Prior known structures have included complicated, rigid structures fitting around the body of the cylinder which hold the sensor tightly against the cylinder body. However, since adjustment of the position of the sensors is often necessary when the piston stroke must be adjusted, such prior structures have often been difficult to move or adjust. Other structures have fixedly mounted the sensing apparatus at the ends of the cylinder eliminating flexibility necessary for complete utilization of the sensing apparatus.

The present invention overcomes the above problems by providing a sensing apparatus which is easily and securely attached to the existing structure of fluid cylinders without the necessity of providing additional ccomplicated, rigid structure and without the necessity of disassembling any portion of the fluid cylinder. The present invention is self-contained and does not require the addition or inclusion of magnets on any part of the body being sensed. Thus, the invention is especially useful with pre-existing fluid cylinders which do not include magnets in their piston bodies.

SUMMARY OF THE INVENTION

Accordingly, the present invention provides a magnetic proximity sensing apparatus especially adapted for use with fluid motive power cylinders of either the pneumatic or hydraulic variety. The apparatus includes a clamping apparatus which allows easy adjustment of the position of the proximity sensor and yet locates the sensor such that it is juxtaposed generally tangentially to a side of the fluid cylinder. When so positioned, a magnet included in the apparatus and positioned immediately adjacent the cylinder senses the entry of the moving piston into the magnetic field of the magnet and immediately responds to the proximity of that piston.

More specifically, the apparatus positions the magnet in a movable rigid member which engages a switch. Only a very small movement of the engaging member is necessary to close the switch and control operation of the fluid cylinder.

In its broader aspects, the apparatus includes switch means secured to base means for closing an electrical circuit in response to the proximity of a piston of a fluid cylinder. An actuator includes a magnet which is attracted by the ferro-magnetic body of a fluid cylinder piston to close the switch and control the operation of the fluid cylinder or other apparatus. Attachment means are included for securing the apparatus to a tie rod of the fluid cylinder such that the magnet is positioned closely adjacent to and approximately tangentially to the fluid cylinder.

In other aspects of the invention, clamping means are provided for easy attachment of the apparatus to the tie rod of either new or pre-existing fluid cylinders without disassembly of the cylinder. The apparatus may be slid along the tie rod for clamping in a desired position without removing the apparatus for the cylinder. Alternately, the clamping apparatus may include a curved flange extending for the sensor housing. A conventional hose clamp extends around the cylinder and the flange for secure positioning.

Replacement of the magnet should it become the weak is easily and simply accomplished without complete disassembly of the apparatus and may be performed even while the apparatus remains attached to the fluid cylinder. The small movement necessary to actuate the switch means provided by the configuration of the apparatus reduces wear of the device thereby extending its durability and useful life over long periods.

These and other objects, advantages, purposes, and features of the invention will become more apparent from a study of the following description taken in conjunction with the drawings.

DESCRIPTION OF THE PREFERRED EMBODIMENT

Figure 2:
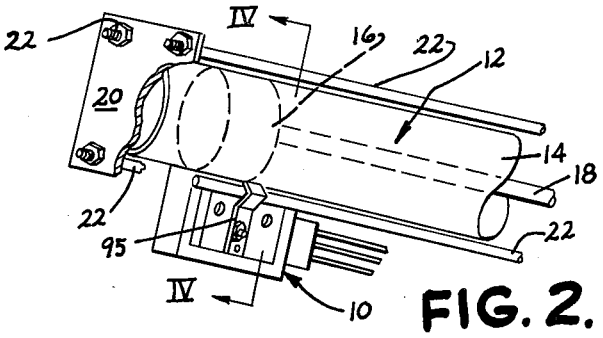
FIG. 2 is a fragmentary, perspective view of a typical fluid cylinder illustrating the proximity apparatus of the present invention secured to a tie rod of the cylinder with portions of the cylinder broken away.
Figure 1:
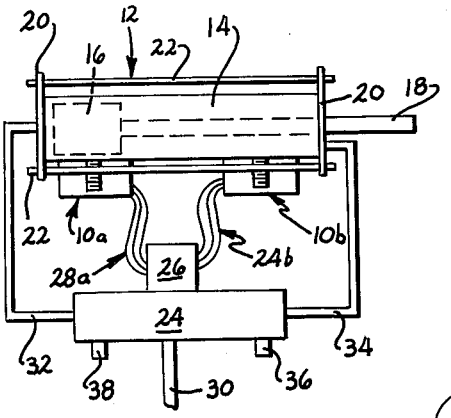
FIG. 1 is a schematic illustration of a pair of the magnetic proximity sensing devices of the present invention secured to a typical fluid motive power cylinder and connected to control the operation of the cylinder via a solenoid-operated fluid valve.

Referring now to the drawings in greater detail, FIGS. 1 and 2 illustrate the magnetic proximity sensing apparatus 10 of the present invention secured to a fluid motive power cylinder 12 of the pneumatic type. Fluid cylinder 12 includes a right, circular cylindrical housing 14 preferably formed from a nonferro-magnetic material including a piston 16 mounted for reciprocal movement therein. Piston 16 is secured to the end of a push or connecting rod 18 which extends outwardly of at least one end of the cylinder for movement of an apparatus to be powered by the cylinder. The ends of housing 14 are closed by closure plates 20 which seal the ends of the cylinder to form a fluid-tight housing. Closures 20 are securely held in place by a plurality of tie rods 22, in this case four, which are spaced equidistantly about the circumference of the cylinder and hold the end closures securely against the ends of housing 14. Typically, piston 16 is formed from a ferro-magnetic material such as hardened steel or the like such that it will be magnetically attractable and attract magnets toward it.

Figure 4:
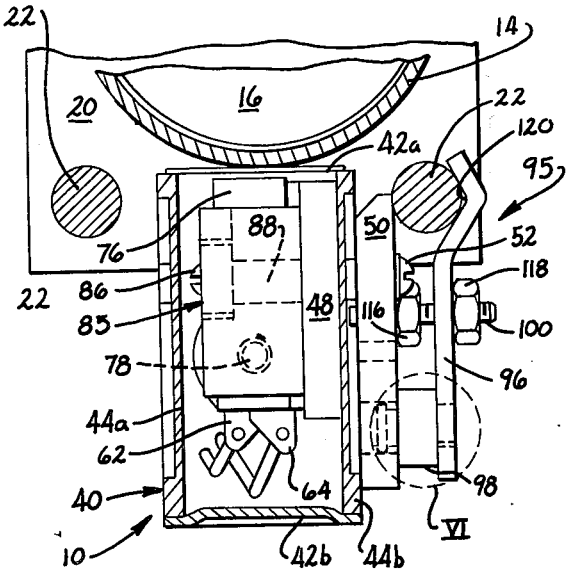
FIG. 4 is a sectional end view of the proximity sensing apparatus secured to a cylinder tie rod tangentially adjacent the cylinder and taken along plane IV—IV of FIG. 2.

As is best seen in FIG. 1, operation of the pneumatic fluid cylinder 12 is controlled by means of a spool valve 24 or the like. Spool valve 24 in turn is operated by an electric, solenoid-operated pilot valve 26 cooperatingly associated with the spool valve 24. A pair of the magnetic proximity sensing apparatus 10*a* and 10*b* are secured at spaced locations on at least one of the tie rods 22 supporting the cylinder 12 such that they lie generally tangentially along a side or sides of cylinder housing 14 against or in close proximity thereto (FIG. 4). Sensors 10*a* and 10*b* are connected via electrical wires 28*a* and 28*b* to the pilot valve 26 to control insertion and exhaust of fluid, in this case compressed air, to opposite sides of piston 16 for movement thereof.

For example, compressed air inserted through supply line 30 to spool valve 24 is directed by appropriate conventional valving within the spool valve to fluid conduit 32. Conduit 32 inserts the fluid at the left end of the cylinder against piston 16 (FIG. 1). Simultaneously, fluid conduit 34 on the opposite side of piston 16 is opened via the valving in spool valve 24 to exhaust outlet 36. Pressure against the left end of piston 16 moves the piston to the right in FIG. 1 until it comes within the influence of the magnetic field of the magnet within sensor 10*b* at the right end of the cylinder. Sensor 10*b* senses the position of the piston head 16, closes an electrical switch, signals pilot valve 26 via electrical wiring 28*b* which closes fluid conduit 34 to halt the rightward movement of the piston head. In a similar manner, when piston 16 is moved to the left via compressed air inserted thereagaint through fluid conduit 34, sensor 10*a* will sense the presence of piston head 16, signal the valving stopping the exhaust of air from the opposite side of the piston through exhaust outlet 38, and halt the leftward movement of the piston. Thus, location of sensors 10*a* and 10*b* controls the length of stroke of piston 16 within cylinder housing 14.

As will be more fully explained below, sensors 10*a* and 10*b* can be moved along the tie rods of the cylinder to adjust the stroke of the piston. An alternate form 130 of the sensor shown in FIGS. 7 and 8 may be secured at any circumferential position around or along a fluid cylinder which does not include an tie rods. Further, the electrical circuitry connected to the sensors may be used to control other apparatus in response to the presence or proximity of the piston head.

Figure 3:
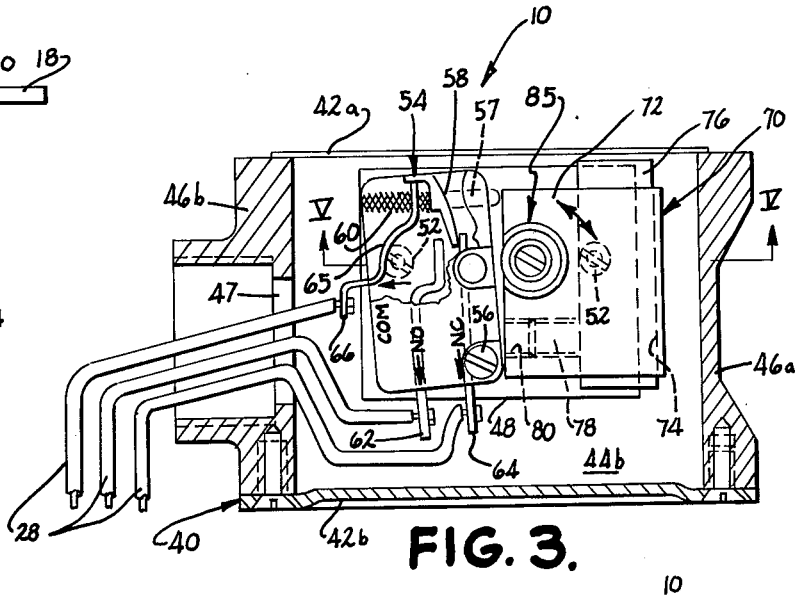
FIG. 3 is a sectional, plan view of the proximity sensing apparatus.
Figure 5:
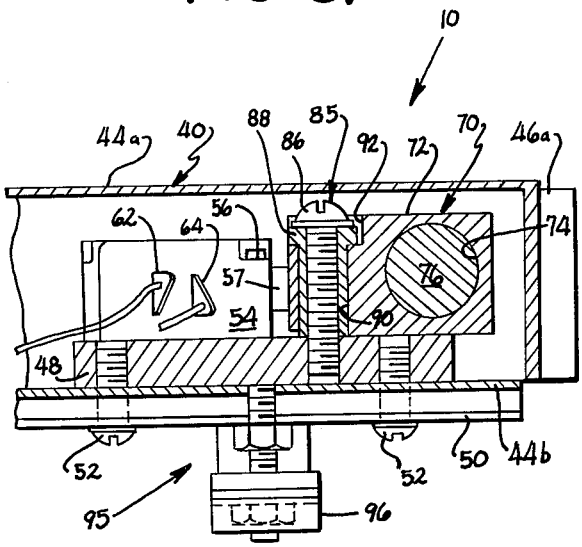
FIG. 5 is a fragmentary, sectional, side elevation of a portion of the sensing apparatus taken along plane V—V of FIG. 3.

As shown in FIGS. 3–5, magnetic proximity sensing apparatus 10 includes a generally rectangular housing 40 including generally planar side walls 42*a*, 42*b*, generally planar top and bottom walls 44*a*, 44*b*, a closed end wall 46*a*, and an end wall 46*b* having an opening 47 therethrough for insertion of electrical wiring. One or more of the sides, top, bottom, or end panels is removably secured via approximate screws or the like to the other panels for access to the internal mechanism of the sensor. The housing 40 provides a cover to protect the internal mechanisms from dust, dirt, and undesired tampering with the mechanisms.

On either side of the bottom wall 44*b* are secured generally planar, internal and exterior base plates 48 and 50, respectively (FIGS. 4 and 5). Plates 48, 50 are secured to wall 44*b* and each other via a pair of machine screws 52 inserted through apertures in plate 50 and wall 44*b* and secured in threaded apertures in base plate 48. Atop base plate 48 generally at one end thereof is mounted an electrical switch 54. Switch 54 is secured at an angle to the direction of extension of the sides and end walls by a pair of securing screws 56. Switch 54 may be one of several conventional switches typically known as miniature snap switches or the like. As shown in FIG. 3, such a switch typically includes a reciprocal plunger 57 biased outwardly by a resilient contact member 58 with the help of a biasing spring 60. Plunger 57 moves contact member 58 between normally open and normally closed contacts 62 and 64, respectively. The contact member 58 thus makes a complete circuit via a wire lead 65 extending from it to the common ground 66. Normally, closed contact 64 may be connected by a wire 28 to an appropriate apparatus such as an indicator light or the like to indicate that the apparatus is operative. Normally open contact 62 may be connected by a wire 28 to the solenoid of an electrical pilot valve such as that shown at 26 in FIG. 1. Accordingly, when plunger 57 is pushed inwardly, contact member 58 moves into contact with normally open contact 62 to close the circuit operating the pilot valve.

In order to close switch 54 in response to the proximity of a ferro-magnetic piston head 16 or the like, an actuator mechanism 70 is provided at the opposite end of inner base plate 48 as shown in FIGS. 3 and 5. Mechanism 70 includes a generally rectangular actuator block 72 pivotally secured in an upright position within housing 40 by a pivot assembly 85. Block 72 includes a right, circular cylindrical aperture 74 extending completely therethrough such that it is generally perpendicular to side wall 42*a* and parallel to the end walls 46*a*, 46*b*. Received within aperture 74 is a right, circular cylindrical rod-like permanent magnet 76 having a portion extending outwardly of the top surface of the lock 72. Magnet 76 is secured within aperture 74 by means of a set screw 78 received in a threaded aperture 80 communicating with aperture 74 from one side surface of the block.

Typically, permanent magnet 76 is a magnet of the Alinco variety, namely, a metallic alloy of aluminum, nickel, and copper. Such a magnet retains its magnetic strength over a long period of time without weakening.

Pivot assembly 85 includes a machine screw or bolt 86 telescoped through a shouldered bushing 88 received in a correspondingly sized aperture 90 extending completely through the thickness of the actuator block 72. The head of bolt 86 and the shoulder on the bushing 88 are received in a generally circular, cylindrical recess 92 formed in the top of the block 72. The shouldered bushing 88 is typically formed from a lubricious material such as synthetic plastic, nylon, brass, or the like and provides a pivot post about which the actuator block 72 pivots to depress plunger 57. The pivot post is generally parallel to the side wall 42. Further, switch 54 is mounted at an angle such that the end of switch 54 opposite the end on which plunger 57 is mounted will contact the side surface of the actuator block 72 and lie in a plane which is perpendicular to the side wall 42*a* when the block is rotated to depress the plunger as seen in FIG. 3.

When the ferro-magnetic piston head of the fluid cylinder 12 moves into close proximity with magnet 76, the magnet will be attracted to the piston head, rotate in a counterclockwise fashion as shown in FIG. 3 about pivot bushing 88 and bolt 86, depress plunger 57, and complete the circuit between contacts 62 and 66 as described above. After the piston head has moved away from its location adjacent and in registry with the permanent magnet 76, the biasing force of contact 56 and spring 60 within switch 54 operate to rotate the actuator block and magnet in a clockwise direction back to its original position. The side surface of the switch at the end opposite the plunger 57 forms a stop which limits the return rotation of the actuator mechanism.

Figure 6:
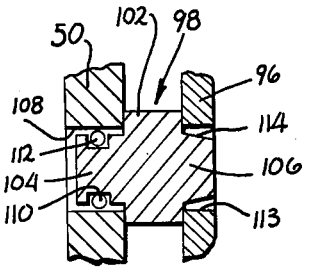
FIG. 6 is an enlarged, sectional view of the spacing means for the clamping arm of the present apparatus specifically illustrating the area VI in FIG. 4.

In order to properly secure the proximity sensing apparatus 10 juxtaposed generally tangentially against the side of cylinder housing 14 (FIGS. 1, 2, and 4), alternate forms of clamping apparatus are provided. A first embodiment 95 of the clamping apparatus includes an elongated clamp arm 96 which is mounted between a spacer assembly 98 (FIG. 6) and a tightening stud 100. Spacer 98 includes a generally cylindrical central body portion 102 having a cylindrical extension 104 extending from one side surface thereof and a tapered, conical extension 106 extending from the opposite side surface. Extension 104 is received in a circular aperture 108 formed in external base plate 50. Aperture 108 has a diameter larger than the diameter of extension 104. An annular groove 110, formed about extension 104, receives a rubber or other synthetic "O" ring 112 therein which has a maximum external diameter slightly greater than the diameter of aperture 108. Accordingly, when extension 104 is inserted in aperture 108, resilient "O" ring fills the gap therebetween and resists withdrawal of the spacer from the aperture. The side surface of body 102 thus contacts the external surface of plate 50 while "O" ring 112 retains the spacer in place.

Extension 106 is tapered and is smaller than the diameter of an aperture 113 extending through one end of the clamp arm 96. Such taper provides an annular, tapered space 114 which allows the clamp arm to pivot to accommodate tie rods of varying diameters. Further, different sizes of spacer members 98 having body sections 102 of different dimensions may be utilized in order to space clamp arm 96 closer or farther away from the external base plate 50 to accommodate smaller or larger size tie rods.

Tightening stud 100 is threaded and inserted in a threaded aperture in external base plate 50, and a nut 116 is counter-tightened to retain the stud therein. A second nut 118 is tightened down against the portion of clamp arm 96 spaced from its connection point to spacer 98 to securely tighten the clamp arm against the tie rod. The free end of clamp arm 96 includes a V-shaped notch, recess, or detent 120 which generally matches the contour of the tie rod forming a seat for the same. As shown in FIG. 4, the tie rod is received between the external surface of plate 50 and notch 120 such that when nut 118 is securely tightened, the apparatus 10 will be held generally tangentially against and along the side of cylinder housing 14 approximately on a radius of the cylinder.

Figure 7:
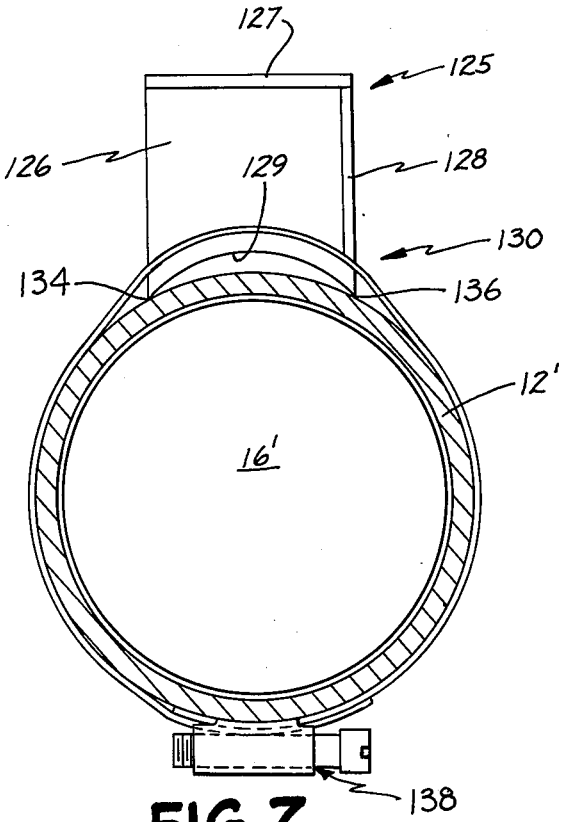
FIG. 7 is a sectional end view of a fluid cylinder which does not require any tie rods for securing end closures thereon including a second form of a clamping apparatus for securing the sensor of the present invention to the body of the cylinder.
Figure 8:
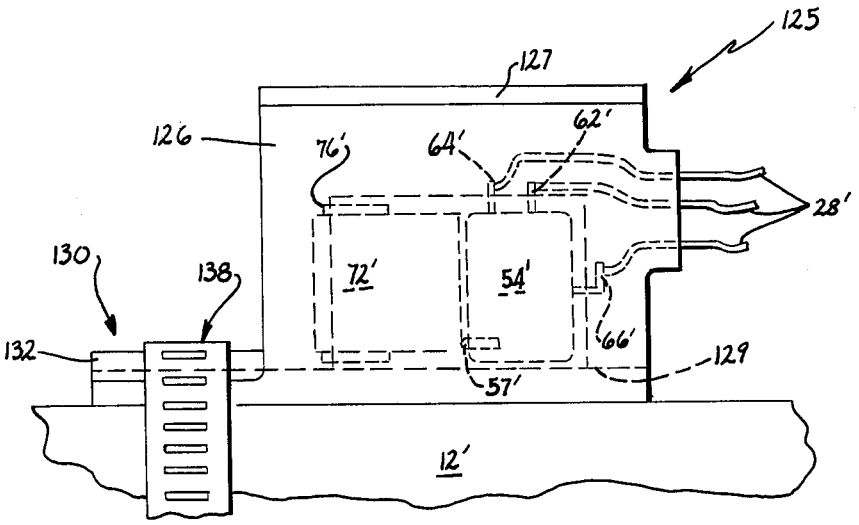
FIG. 8 is a fragmentary, side elevation of the fluid cylinder with the sensor secured thereon illustrated in FIG. 7.

As illustrated in FIGS. 7 and 8, an alternative embodiment 125 of the proximity sensor includes an alternatively clamping apparatus 130 for securing the proximity sensor to the body of a fluid cylinder. In this case, the fluid cylinder 12' is of the type which does not require any tie rods for securing end closure portions thereto. Typically, as with cylinder 12, cylinder 12' is a right, circular cylinder through which reciprocates a right circular cylinder piston 16' with a conventional sealing means between the piston and the inside diameter of the cylinder.

Sensor 125 includes a generally rectangular housing 126 having a desired number of removable top or side plates 127, 128 which may be removed from the remainder of the generally rectangular housing for access to the interior sensor apparatus shown in FIG. 8. The interior apparatus is generally similarly located to that described in embodiment 10 above wherein similar elements are indicated with the same numbers with the addition of primes. The bottom surface 129 of housing 126 is generally formed by casting or the like in an arcuate fashion such that is includes a radius substantially smaller than that of the fluid cylinder to which it will be attached. This arcuate surface extends the length of the housing 126 and beyond the closed end surface of the housing forming clamping apparatus 130.

Clamping apparatus 130 includes a curved, arcuate, extending flange 132 extending beyond the closed end surface of the housing. The flange has an arc matching that of the undersurface of the housing, the radius of which is substantially smaller than the cylinder to which it will be attached. The lateral edges of the housing and flange 132 at the bottom surface 129 form sharp longitudinally extending rectilinear edges 134, 136 which engage and grip the surface of the cylinder to hold the proximity switch as located when clamped with a conventional hose clamp 138 (FIG. 7). The hose clamp includes a bendable strap and threaded flanges with a threaded screw extending therebetween for tightening the strap. The hose clamp is preferably secured over the arcuate flange 132 and around the entirety of the fluid cylinder body and tightened securely such that the edges 134, 136 grip tightly against the exterior surface of the cylinder 12'.

When so positioned with clamping apparatus 95 or 130, the axis of cylindrical permanent magent 76 is generally perpendicular to the housing wall of the sensor which lies generally tangentially or immediately adjacent the external surface of the housing of the fluid cylinder. The cylindrical axis of magnet 76 is the polar axis and the end of magnet 76 closest to the housing wall of the sensor is the pole of the magnet which is attracted to the ferro-magnetic piston head 16. Accordingly, the cylindrical, polar axis of magnet 76 is positioned approximately on a radius of the fluid cylinder 14 when clamped in position with clamping apparatus 95 or 130. This maximizes the effect of the magnetic field of the magnet so that the actuating mechanism 70 will be sensitive and highly responsive to the presence of a ferromagnetic object in close proximity thereto. Moreover, the configuration of the actuating mechanism in relation to plunger 57 of switch 54 necessitates only a short movement for closing the circuit with contact 62 to operate the fluid cylinder control mechanism.

Clamping apparatus 95 allows the sensing apparatus to be secured as described above without dissambling the fluid cylinder by simply loosening nut 118, slipping tie rod 22 between base plate 50 and detent 120 of clamp arm 96 and thereafter tightening the nut 118. The position of the sensing apparatus 10 may be adjusted along the length of the cylinder merely by loosening nut 118, sliding the apparatus to the desired position, and retightening the nut.

Embodiment 125 of the sensor including clamping apparatus 130 may be secured in virtually any position around the 360° circumference of the cylinder 12' or anywhere along the length thereof to accurately sense the motion of the ferro-magnetic piston 16' therewithin. This clamping apparatus, like embodiment 95, also enables repair or replacement of the interior portions of the sensor without removal of the housing from the cylinder by removal of plates 127, 128. Further, adjustment in the position of the sensor 125 is made simply and quickly by merely loosening the screw in the hose clamp 138 and adjusting the sensor position along or around the cylinder when the hose clamp can be retightened.

Accordingly, the apparatus may be simply and easily applied to existing fluid cylinders for accurate, precise, and reliable control of the fluid cylinder and other apparatus designed to be operated in response to movement of a fluid cylinder.

While one form of the invention has been shown and described, other forms will now be apparent to those skilled in the art. Therefore, it will be understood that the embodiment shown in the drawings and described above is merely for illustrative purposes and is not intended to limit the scope of the invention which is defined by the claims which follow.

The embodiments of the invention in which an exclusive property or privilege is claimed are defined as follows:

1. A magentic proximity apparatus for use with fluid cylinders of the type including a cylinder, a magnetically attractive piston mounted for movement within the cylinder, and tie rods extending along and spaced outwardly from the exterior surface of the cylinder between support means at the ends of the cylinder, said apparatus comprising a base means supporting said apparatus, switch means secured to said base means for completing an electrical circuit; actuator means for closing said switch means in response to the proximity of a piston of a fluid cylinder, said actuator means including a magnet, means for movably supporting said magnet, and means for engaging said switch means; said magnet adapted to be attracted toward a fluid cylinder piston when the piston is in proximity to the magnet to move said engaging means to close said switch means; and clamping means securing said apparatus to one of the tie rods of the fluid cylinder, which tie rod is spaced outwardly therefrom, such that said magnet is positioned closely adjacent to and approximately tangentially to the fluid cylinder; said clamping means including a clamping arm having two ends and spacer means extending between one end of said clamping arm and said base means for spacing said one end of said clamping arm from said base means, said spacer means including a body having a first portion received in a portion of said base means and a second portion received in a portion of said one end of said clamping arm at a position spaced from the other end of said clamping arm; and tightening means extending between said clamping arm and base means and positioned intermediate said body and said other end of said clamping arm for tightening said clamping arm toward said base means to securely clamp the tie rod between said clamping arm and base means.

2. The apparatus of claim 1 wherein said clamping arm has a detent adapted to generally fit the contour of said tie rod to retain said tie rod in position along said clamping arm.

3. The apparatus of claim 1 wherein said spacer means also includes a resilient retaining means fitted between said first portion of said body and said portion of said base means for retaining said body on said apparatus.

4. The apparatus of claim 1 in combination with a fluid cylinder comprising a hollow, cylindrical housing, a piston mounted for movement within said housing, closure means for closing the ends of said cylinder, and at least one tie rod extending between said closure means, along the side of and spaced outwardly from the exterior surface of said cylinder; said proximity apparatus being secured to said tie rod with said clamping means such that it lies generally tangentially along said fluid cylinder with said magnet extending generally radially away from said fluid cylinder.

5. The apparatus of claim 1 wherein said actuator means include a block, means for holding said magnet on said block, and pivot means for pivotally securing said block to said base means; said switch means including a plunger and biasing means for biasing said plunger to open the circuit and urge said block and magnet away from said switch means.

6. The apparatus of claim 5 wherein said pivot means includes a shouldered bushing received in an aperture in said block and a bolt extending through said bushing and block and secured to said base means for holding said block against said base means.

7. The apparatus of claim 5 wherein said magnet is a cylindrical, rod-like permanent magnet positioned within an aperture in said block such that its cylindrical axis is adapted to extend generally radially outwardly of a fluid cylinder when said apparatus is secured thereto whereby the magnetic pole of said magnet to be attracted by a fluid cylinder piston is positioned immediately adjacent said fluid cylinder.

8. The apparatus of claim 1 wherein said magnet is a cylindrical, rod-like permanent magnet positioned on said means for movably supporting said magnet such that its cylindrical axis is adapted to extend generally radially outwardly of the fluid cylinder when said apparatus is secured thereto whereby the magnetic pole of said magnet to be attracted by the fluid cylinder piston is positioned immediately adjacent said fluid cylinder.

9. Magnetic proximity sensing apparatus for use with fluid cylinders having magnetically attractive pistons comprising base means supporting said apparatus; switch means secured to said base means for completing an electrical circuit actuator means for closing said switch means in response to the proximity of a piston of a fluid cylinder including a magnet having an axis extending between its poles, block means holding said magnet and for engaging said switch means including an aperture having an axis and extending completely through said block means and receiving said magnet such that the magnet and aperture axes are parallel to one another and fastening means inserted in said block means and engaging said magnet removably securing said magnet in said aperture, and means for pivotally securing said block means adjacent to and in engagement with switch means; and means for biasing said block means away from said switch means to open the electrical circuit except when said magnet is attracted toward a fluid cylinder piston; said aperture and magnet positioned in said block means such that said magnet polar axis will extend radially away from a fluid cylinder when secured thereto; housing means covering said switch means and actuator means; and means securing said apparatus to a fluid cylinder with said magnet immediately adjacent the cylinder whereby said actuator means will respond to the close proximity of a fluid cylinder piston to close said switch means.

10. The apparatus of claim 9 wherein said magnet is a cylindrical, rod-like permanent magnet positioned within an aperture in said block means such that its cylindrical axis is adapted to extend generally radially outwardly of a fluid cylinder when said apparatus is secured thereto whereby the magnetic pole of said magnet to be attracted by the fluid cylinder piston is positioned immediately adjacent said fluid cylinder.

11. The apparatus of claim 9 wherein said means for pivotally securing said block means includes a shouldered bushing received in an aperture in said block means and a bolt extending through said bushing and block means and secured to said base means for holding said block means against said base means.

12. The apparatus of claim 9 wherein said means for securing said apparatus to a fluid cylinder include a clamping member having two ends and adapted to engage a fluid cylinder tie rod spaced from the exterior surface of and extending along the fluid cylinder and spacer means including resilient retaining means retaining said spacer on said apparatus; and tightening means extending between said clamping member and said base means and positioned intermediate said spacer means and the other end of said clamping member for tightening said clamping member toward said base means to securely clamp a tie rod therebetween.

13. The apparatus of claim 9 in combination with a fluid cylinder comprising a hollow, cylindrical housing, a piston mounted for movement within said housing, closure means for closing the ends of said cylinder, and at least one tie rod extending between said closure means and along and spaced outwardly from the side of said cylindrical housing; said proximity apparatus being secured to said tie rod with said means securing said apparatus to a fluid cylinder such that it lies generally tangentially along said fluid cylinder with said magnet extending generally radially away from said fluid cylinder.

14. The apparatus of claim 9 wherein said means for securing said apparatus to a fluid cylinder include flange means extending to one side of said housing means; strap means extending over said flange means and around the fluid cylinder; and means for tightening said strap means around said flange means and the cylinder means.

15. The apparatus of claim 14 wherein said flange means is adapted to extend longitudinally of the fluid cylinder and is curved generally transverse to the longitudinal direction of the cylinder, said flange means having a radius of curvature less than that of the fluid cylinder and lateral sharp edges thereon for gripping the cylinder surface to locate and hold said sensing apparatus in position.

16. The apparatus of claim 14 including gripping means on the cylinder-engaging side of said flange means for engaging and gripping the fluid cylinder surface to hold said sensing apparatus in position on the cylinder.

17. A magnetic proximity apparatus for use with fluid cylinders of the type including a cylinder and a magnetically attractive piston mounted for movement within the cylinder, said apparatus comprising:

a base means supporting said apparatus;

switch means secured to said base means for completing an electrical circuit;

actuator means for closing said switch means in response to the proximity of a piston of a fluid cylinder, said actuator means including a magnet, means for movably supporting said magnet, and means for engaging said switch means; said magnet adapted to be attracted toward a fluid cylinder piston when the piston is in proximity to the magnet to move said engaging means to close said switch means; and clamping means securing said apparatus to a fluid cylinder such that said magnet is positioned closely adjacent to and extending generally radially outwardly of the fluid cylinder, said clamping means including curved flange means extending to one side of said apparatus engaging the fluid cylinder, strap means engaging the outer circumference of said curved flange means and extending around the fluid cylinder, and means for tightening said strap means around said flange means and the fluid cylinder to hold said apparatus in position on said fluid cylinder.

18. The apparatus of claim 17 wherein said flange means is adapted to extend longitudinally of the fluid cylinder and is curved generally transverse to the longitudinal direction of the cylinder, said flange means having a radius of curvature less than that of the fluid cylinder and lateral sharp edges thereon gripping the cylinder surface to locate and hold said apparatus in position.

19. The apparatus of claim 17 including gripping means on the cylinder-engaging side of said flange means engaging and gripping the fluid cylinder surface to hold said apparatus in position on the cylinder.

20. A magnetic proximity apparatus for use with fluid cylinders of the type including a cylinder, a magnetically attractive piston mounted for movement within the cylinder, and tie rods extending along the cylinder between support means at the ends of the cylinder, said apparatus comprising a base means supporting said apparatus, switch means secured to said base means for completing an electrical circuit; actuator means for closing said switch means in response to the proximity of a piston of a fluid cylinder, said actuator means including a magnet, means for movably supporting said magnet, and means for engaging said switch means; said magnet adapted to be attracted toward a fluid cylinder piston when the piston is in proximity to the magnet to move said engaging means to close said switch means; and clamping means securing said apparatus to the tie rod of a fluid cylinder such that said magnet is positioned closely adjacent to and approximately tangentially to the fluid cylinder, said clamping means including rigid means engaged about at least a portion of the fluid cylinder tie rod and means for tightening said rigid means against said tie rod; said rigid means including a clamping arm having a detent generally fitting the contour of said tie rod and spacer means for spacing one end of said clamping arm from said base means; said base means including an aperture; said clamping arm also including an aperture, said spacer means including a body fitted between said clamping arm and said base means, a first extension received in said aperture in said base, and a second extension received in said aperture in said clamping arm; said first extension being smaller than said aperture in said base means and including a resilient member extending said first extension and resiliently between said first extension and the sides of said aperture in said base means to retain said spacer on said base means; said second extension being smaller than said aperture in said clamping arm to allow pivotal movement of said clamping arm about said second extension.

21. The apparatus of claim 20 wherein said resilient member is an O-ring having an exterior dimension slightly greater than the dimension of said aperture in said base means.

22. A magnetic proximity apparatus for use with fluid cylinders of the type including a cylinder, magnetically attractive piston mounted for movement within the cylinder, and tie rods extending along and spaced outwardly from the exterior surface of the cylinder between support means at the ends of the cylinder, said apparatus comprising a base means supporting said apparatus, means on said base means including an electric switch responsive to the proximity of the magnetically attractive piston within the cylinder for closing an electric circuit and response to the proximity of the piston; and clamping means securing said apparatus to one of the tie rods of the fluid cylinder, which tie rod is spaced outwardly therefrom; said clamping means including a clamping arm having two ends and spacer means extending between one end of said clamping arm and said base means for spacing said one end of said clamping arm from said base means, said spacer means including a body having a first portion engaging and retained on a portion of said base means and a second portion engaging and supporting a portion of said one end of said clamping arm at a position spaced from the other end of said clamping arm; and tightening means extending between said clamping arm and base means and positioned intermediate said body and said other end of said clamping arm for tightening said clamping arm toward said base means to securely clamp a tie rod between said clamping arm and base means.

23. A magnetic proximity apparatus including a cylinder and a magnetically attractive piston mounted for movement within the cylinder, said apparatus comprising:

a base means supporting said apparatus;

means including electric switch means secured to said base means for completing an electrical circuit in response to the proximity of the magnetically attractive piston within the fluid cylinder; and clamping means securing said apparatus to a fluid cylinder including curved flange means extending to one side of said apparatus for engaging a fluid cylinder, strap means engaging the outer circumference of said curved flange means for extending around a fluid cylinder, and means for tightening said strap means around said flange means and a fluid cylinder to hold said apparatus in position on said fluid cylinder, said flange means being adapted to extend longitudinally of a fluid cylinder and being curved generally transverse to the longitudinal direction of the cylinder, said flange means having a radius of curvature less than that of the fluid cylinder and lateral sharp edges thereon for gripping the cylinder surface to locate and hold said apparatus in position.

24. A magnetic proximity apparatus for use with fluid cylinders of the type including a cylinder, a magnetically attractive piston mounted for movement within the cylinder, and tie rods extending along and spaced outwardly from the exterior surface of the cylinder between support means at the ends of the cylinder, said apparatus comprising a support means supporting said apparatus, means on said support means including an electric switch responsive to the proximity of the magnetically attractive piston within the cylinder for closing an electric circuit in response to the proximity of the piston; and clamping means securing said apparatus to the tie rod of the fluid cylinder, which tie rod is spaced outwardly therefrom; said clamping means including a clamping arm having two ends and recess means at one end and contoured to the shape of the tie rod and receiving the tie rod and retaining the apparatus on the fluid cylinder; attaching means at the other end of said clamping arm attaching said clamping arm to said support means; and tightening means positioned intermediate the ends of said clamping arm for tightening said recess means on said clamping arm toward said support means whereby said apparatus may be securely clamped to the fluid cylinder in position to sense the proximity of the piston within the fluid cylinder.

* * * * *

UNITED STATES PATENT AND TRADEMARK OFFICE

CERTIFICATE OF CORRECTION

PATENT NO. : 4,071,725

DATED : January 31, 1978

INVENTOR(S) : JOHN L. SMITH and CLAIR B. ALEXANDER

It is certified that error appears in the above-identified patent and that said Letters Patent are hereby corrected as shown below:

Column 1, Line 13:

After "operation" please insert --of other--.

Column 1, Line 17:

"type" should be --types--.

Column 1, Line 25:

"cylinder" should be --cylinders--.

Column 1, Line 43:

"ccomplicated" should be --complicated--.

Column 2, Line 18:

"for" should be --from--.

Column 2, Line 20:

"for" should be --from--.

UNITED STATES PATENT AND TRADEMARK OFFICE

CERTIFICATE OF CORRECTION

PATENT NO. : 4,071,725

DATED : January 31, 1978

INVENTOR(S) : JOHN L. SMITH and CLAIR B. ALEXANDER

It is certified that error appears in the above-identified patent and that said Letters Patent are hereby corrected as shown below:

Column 2, Line 23:

Please delete "the" (second occurrence)

Column 3, Line 55:

"thereagaint" should be --thereagainst--.

Column 3, Line 67:

"an" should be --any--.

Column 4, Line 10:

"approximate" should be --appropriate--.

Column 5, Line 47:

After "ring" please insert --112--.

Column 6, Lines 9 and 10:

"alternatively" should be --alternative--.

UNITED STATES PATENT AND TRADEMARK OFFICE

CERTIFICATE OF CORRECTION

PATENT NO. : 4,071,725

DATED : January 31, 1978

INVENTOR(S) : JOHN L. SMITH and CLAIR B. ALEXANDER

It is certified that error appears in the above-identified patent and that said Letters Patent are hereby corrected as shown below:

Column 6, Line 16:

"cylinder" should be --cylindrical--.

Column 6, Line 53:

"magent" should be --magnet--.

Column 6, Line 56:

After "adjacent" please insert --against--.

Column 7, Line 5:

"dissambling" should be --disassembling--.

Column 7, Line 42:

"magentic" should be --magnetic--.

Column 9, Line 36:

After "and" (second recitation) please insert --spacer means spacing one end of said clamping member from said base means, said --.

UNITED STATES PATENT AND TRADEMARK OFFICE

CERTIFICATE OF CORRECTION

PATENT NO. : 4,071,725

DATED : January 31, 1978

INVENTOR(S) : JOHN L. SMITH and CLAIR B. ALEXANDER

It is certified that error appears in the above-identified patent and that said Letters Patent are hereby corrected as shown below:

Column 11, Line 11:

After "extending" please insert --around--.

Column 11, Line 24:

After "cylinder," please insert --a--.

Column 11, Line 33:

"and" should be --in--.

Signed and Sealed this

*Third* Day of *October 1978*

[SEAL]

*Attest:*

RUTH C. MASON
*Attesting Officer*

DONALD W. BANNER
*Commissioner of Patents and Trademarks*